US008573307B2

(12) United States Patent
Moksvold

(10) Patent No.: US 8,573,307 B2
(45) Date of Patent: Nov. 5, 2013

(54) HIGH PRESSURE SLEEVE FOR DUAL BORE HP RISER

(75) Inventor: Harald Moksvold, Maura (NO)

(73) Assignee: Ocean Riser Systems AS, Oslo (NO)

( * ) Notice: Subject to any disclaimer, the term of this patent is extended or adjusted under 35 U.S.C. 154(b) by 435 days.

(21) Appl. No.: 12/427,003

(22) Filed: Apr. 21, 2009

(65) Prior Publication Data

US 2009/0260831 A1 Oct. 22, 2009

Related U.S. Application Data

(60) Provisional application No. 61/071,280, filed on Apr. 21, 2008.

(51) Int. Cl.
*E21B 43/013* (2006.01)
*E21B 33/037* (2006.01)

(52) U.S. Cl.
USPC ..... 166/350; 166/345; 166/347

(58) Field of Classification Search
USPC ..... 166/338, 343, 345, 359, 360
See application file for complete search history.

(56) References Cited

U.S. PATENT DOCUMENTS

| | | | | | |
|---|---|---|---|---|---|
| 3,062,288 | A * | 11/1962 | Haeber | | 166/359 |
| 3,858,648 | A * | 1/1975 | Jett | | 166/120 |
| 4,067,385 | A * | 1/1978 | Schwager et al. | | 166/343 |
| 5,129,459 | A * | 7/1992 | Breese et al. | | 166/339 |
| 5,377,762 | A * | 1/1995 | Turner | | 166/339 |
| 6,015,013 | A * | 1/2000 | Edwards et al. | | 166/360 |
| 6,070,668 | A * | 6/2000 | Parks et al. | | 166/345 |
| 6,170,578 | B1 * | 1/2001 | Edwards et al. | | 166/339 |
| 6,186,237 | B1 * | 2/2001 | Voss et al. | | 166/337 |
| 6,273,193 | B1 | 8/2001 | Hermann et al. | | |
| 6,557,638 | B2 * | 5/2003 | Cunningham et al. | | 166/348 |
| 6,561,276 | B2 * | 5/2003 | Hamilton | | 166/339 |
| 6,968,902 | B2 * | 11/2005 | Fenton et al. | | 166/358 |
| 7,331,394 | B2 * | 2/2008 | Edwards et al. | | 166/339 |
| 7,658,228 | B2 * | 2/2010 | Moksvold | | 166/345 |
| 2002/0066559 | A1 * | 6/2002 | Hamilton | | 166/117.5 |
| 2006/0219411 | A1 | 10/2006 | Moksvold | | |
| 2009/0223671 | A1 * | 9/2009 | Edwards et al. | | 166/344 |

FOREIGN PATENT DOCUMENTS

| | | | |
|---|---|---|---|
| DE | 4204109 | A1 * | 8/1993 |
| DE | 4424917 | A1 * | 1/1996 |
| GB | 2258675 | A1 | 9/2005 |
| GB | 2412130 | A | 9/2005 |
| JP | 1-178606 | * | 7/1989 |
| WO | WO 03067023 | A1 | 8/2003 |

OTHER PUBLICATIONS

International Search Report in PCT/NO2009/000151.

* cited by examiner

*Primary Examiner* — Matthew Buck
*Assistant Examiner* — James Sayre
(74) *Attorney, Agent, or Firm* — Manelli Selter PLLC; Edward J. Stemberger

(57) ABSTRACT

A high pressure sleeve for a dual bore high pressure riser is provided. The high pressure sleeve is arranged for forming a connection between either the annulus bore and the high pressure sleeve, or for forming a connection between the high pressure sleeve and the production bore. The choice of connection is made by rotation of the sleeve.

3 Claims, 2 Drawing Sheets

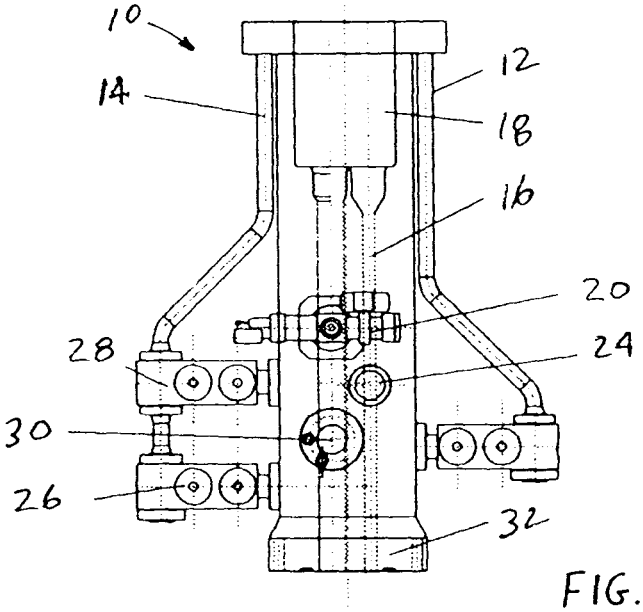
FIG. 1
Fig 2a.
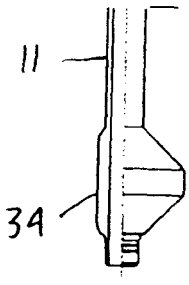
Fig 2b.
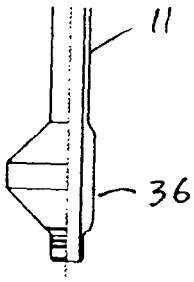
Fig 3.
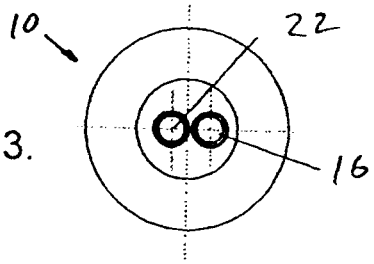

HIGH PRESSURE SLEEVE FOR DUAL BORE HP RISER

This application is based on U.S. Provisional Application No. 61/071,280 filed on Apr. 21, 2008, claims the benefit thereof for priority purposes, and is hereby incorporated by reference into this specification.

BACKGROUND

The present invention relates to offshore drilling and well activities preformed from a floating drilling or workover rig or vessel. Today, when an offshore sub-sea well is intervened (work performed inside the production tubing below a sub-sea x-mas tree) from a floating vessel, a high pressure work-over riser system is used. Such work-over riser systems have been designed with a subsea shut off valve lower riser package and/or a blow out preventer configuration close to the seabed and includes a riser disconnect package (RDP), to allow for a riser disconnect closer to the seabed when situations call for it. On the surface, the high pressure riser is terminated in a surface test tree (series of valves) above the rigfloor. To allow for riser tension, the drilling rig's main blocks for lowering and hoisting drillpipe is used to pull tension on the workover riser. Above the surface test tree, the pressure control equipment (surface BOP) for the well operations is installed, for lubricating into the well all of the work-over tools used in the high pressure operation.

If the work-over system is being used inside a 21" drilling riser, the lower shutoff valves in the workover riser system close to seabed, are controlled independent of the drilling BOP on the outside and carry independent equipment for service of the well. To run all of this equipment inside the drilling riser is very time consuming, in that the rig crew first has to run the 21" marine drilling riser and the 18¾ drilling BOP and suspend this system in the drilling rig's riser tension system underneath the rig floor. Then the rig crew has to run the workover riser system inside the marine drilling riser all the way to seabed and connect this riser to the outer drilling subsea BOP in the lower end and suspend this riser system in the rig's main drilling hook by help of an elevator or lifting frame in the upper end. In doing so, the main travelling blocks/hook is occupied and will prevent the rig from being able to run jointed pipe into the workover riser.

If the high pressure riser is run as a stand alone system in open waters, the subsea blowout preventer (BOP) and the riser disconnect package (RDP) is installed on top of the subsea x-mas tree. This riser system is to date not intended for use with jointed drillpipe but intended for extending the production tubing up to the drilling rig's work deck or rigfloor, so that wire line and coil tubing can be run into the well. This riser system is then hung off in the rig's drilling riser tensioning system and/or in the drilling hook with the help of an elevator or lifting frame. The surface BOP's for the workover riser system is then installed above the rig floor and above the elevator to the rigs main hoisting system. This will also prevent the rig from being able to run jointed drillpipe into the well, since the equipment for running jointed pipe is occupied holding tension in the riser system. Hence with prior art, it is not possible to change from running wire line or coiled tubing equipment into the well, into the process of running jointed drillpipe into the well or vice versa, without having to change out the whole riser system or disconnecting the riser from the production sub-sea x-mas tree.

The operating limits upon intervention are as follows: 4 meters of rig heave before disconnect, and riding belt operations are suspended at 1.5 meters of heave at a maximum wind speed of 40 knots of wind. These conditions are quite tight, in particular in harsh climates such as the North Sea. When this is compared operating parameters of drilling being: The drilling operations are stopped if weather conditions are above the following parameters: 5 meters rig heave and increasing, wind above 64 knots. Weather conditions for disconnecting drilling riser: 6-10 meter heave and increasing, Problems with station keeping/High anchor tension, maximum flexjoint angle is 8° and increasing. As is evident, there is a large difference in the operating windows between these parameter sets, thus it would a significant improvement to be able to increase the window of operations for intervention.

Conventional Systems

When completing a well with a conventional vertical X-mas tree system, a dual bore riser is used. The vertical X-mas tree has two bores, production- and annulus bore which contain valves, normally gate valves, in both bores. As a minimum both bores have 1 master valve and 1 swab valve in addition to wing valves and X-over valves etc. none of which form part of the vertical bore. Extended from these two bores the dual bore riser runs all the way back to the rig. The riser is then terminated in the surface test tree or similar which carries an interface which is suspended in the blocks. Above the surface test tree a set of wire line or coiled tubing BOPs are located. Normally only one bore holds the BOPs as the distance between the bores are narrow and there is no room to hold BOPs for both the annulus and production bore. Normally the annulus bore is 2" nominal and the production bore has an ID of 4" to 6⅝".

When a wire line or coiled tubing run is to be performed the BOPs are located on the production or annulus bore and the tool string is inserted by penetrating the BOPs and into the bore. Normally a lubricator is used at the top where the tool string is entered. After having pressure tested the bore and lubricator, the run is performed. When the run is completed in one bore the operation is repeated in the opposite sequence to remove the tool string.

When completing a well or performing Plug and abandonment of a well the need to run plugs in the tubing hanger for isolation and sealing off the well is required. This is then done by installing or removal of a plug in one bore before moving all BOPs etc to the opposite bore for conducting the same operation in that bore. This is a time-consuming operation with personnel subjected to rig heave and weather conditions. Much of the work must be performed in riding belts, operations which in the North sea are limited by the 1.5 meter rig heave and 40 knots wind limitation.

BACKGROUND ART

The applicant has previously disclosed a method for the intervention in wells through a high pressure workover and drilling riser in U.S. Ser. No. 11/375,061, and GB2412130, the content of both of these references being hereby incorporated by reference into this specification.

The disclosure of GB2412130 specifies the use of a high pressure workover and drilling riser with two BOP stacks (sub-sea and near surface), where the upper BOP (20) is placed below the rig floor (90) and is interfacing a conventional low pressure drilling riser (30) and/or slip-joint (40) (41) as seen in FIG. 1. This figure also includes one conventional marine drilling riser (30) below the slip joint and wherein the whole riser system is being suspended by the rig's riser tensioning system (45), for placement of the upper BOP (20) below the wave affected zone near sea level. The purpose of this arrangement is to be able to drill with jointed drillpipe under harsher weather conditions where rig heave needs to be considered for the operation.

This patent application describes the introduction of a short high pressure riser sleeve system (60) which is integrating the upper BOP (20) (inside the low pressure drilling slip joint (40)(41), which in combination with the high pressure riser system (10) described above, will make the change from running jointed drillpipe to allowing underbalanced operations with spooled equipment more effective and swift. Hence the high pressure riser sleeve can be run from the rig floor (90) down to the high pressure interface (25 in FIG. 3) above the upper BOP, thereby creating a HP conduit to the well. FIG. 3 describes the upper BOP (20) and how it integrates to the low pressure drilling riser (30) with high pressure chokelines (50) and kill line (51) with the high pressure riser integration joint (60) inside and to the top of the high pressure riser (10) with an easy make up connector (21) to the high pressure riser (10). This system has a plurality of advantages as is evident.

U.S. Ser. No. 11/375,061 further refers to FIG. 4 for a description of the interface between the high pressure sleeve and high pressure riser. The high pressure sleeve comprises a bottom section (61) or (65) which interfaces the top of the sub surface BOP stack (25). The connection comprises seals in order to seal off between the sleeve and the high pressure section of the upper BOP (20) to prevent well fluid to leak off into the low pressure riser system In addition, the bottom section shall be locked down in order to keep the sleeve in a stationary position, independent of well pressure and pull performed by the top tension (elevators and main drilling hook).

The interface (25) to lock down the bottom section to the upper BOP stack (20) may be a threaded connection (61), "J" slot interface system or a latch mechanism (65), all performing the lock down function that is required. FIG. 3 shows a threaded interface (61) and a latch type interface (25). The seals described should have the ability to seal off the section between the bottom section and the top of the upper BOP. The sealing arrangement should comply with the same pressure rating as the upper BOPs.

In addition or instead of using said seals, the bottom section can carry a lower sleeve (62) which can interface the sub surface BOPs (20). The shown sleeve extension in FIG. 3 (62) will interface the annular preventer (23) or the ram type BOP (22), which allows for the sealing capability as listed above or form a secondary seal in addition to the seals explained above. The top interface of the bottom section (61) (65) should interface the tube or sleeve running back to the drill floor (90) through the rotary table. This part comprises high pressure tubing (60) in compliance to tools run in the well and at the same time keeps the pressure integrity as required for the well or having the same pressure rating as the upper BOP (20).

The top termination of the sleeve should interface a surface test tree (63) or similar equipment as the X-over section to where the wire line BOPs or coiled tubing BOPs interface will be established (64). As an example, a simplified surface test tree (63) is shown with the elevator (68) interface to carry the suspension of the sleeve and the wire line BOPs or the coiled tubing equipment required for a well intervention. To ease the installation operation of the tool strings etc. into the sleeve or well, a telescope section can be a part of the high pressure sleeve section. Such a telescopic section can be arranged so that it forms a part of the sleeve. Such telescopic system is considered prior art and is described amongst others in PCT WO 03/067023 A1. The purpose of the telescopic system is to collapse the section when running tools in or out of the sleeve in order to avoid moving parts caused by rig movement while carrying out this operation. When in operation the telescope will need to follow the riser part in case any shut in of the well is required. This telescope is not shown in the drawings.

Thus there is presented in the previously known application a method for intervention in wells during underbalanced operations. However there is no description of using the system for dual bore riser systems, systems which are commonly in use.

SUMMARY

The present application seeks to overcome at least some of the disadvantages of the background art and comprises a high pressure sleeve for a dual bore high pressure riser, wherein high pressure sleeve is arranged said for forming a connection between either the annulus bore and the high pressure sleeve, or for forming a connection between the high pressure sleeve and the production bore, and wherein the choice of connection is made by rotation of said sleeve.

BRIEF DESCRIPTION OF THE DRAWINGS

FIG. 1 shows a subsea BOP to which the HP sleeve is to be connected.

FIG. 2*a* shows a lower HP sleeve pin end according to the invention in tubing mode, whereas FIG. 2*b* shows the lower HP sleeve pin end in annulus mode.

FIG. 3 is a top view of the subsurface BOP showing the production/tubing bore and the annulus bore.

DETAILED DESCRIPTION OF EXAMPLE EMBODIMENTS

Figure 4:
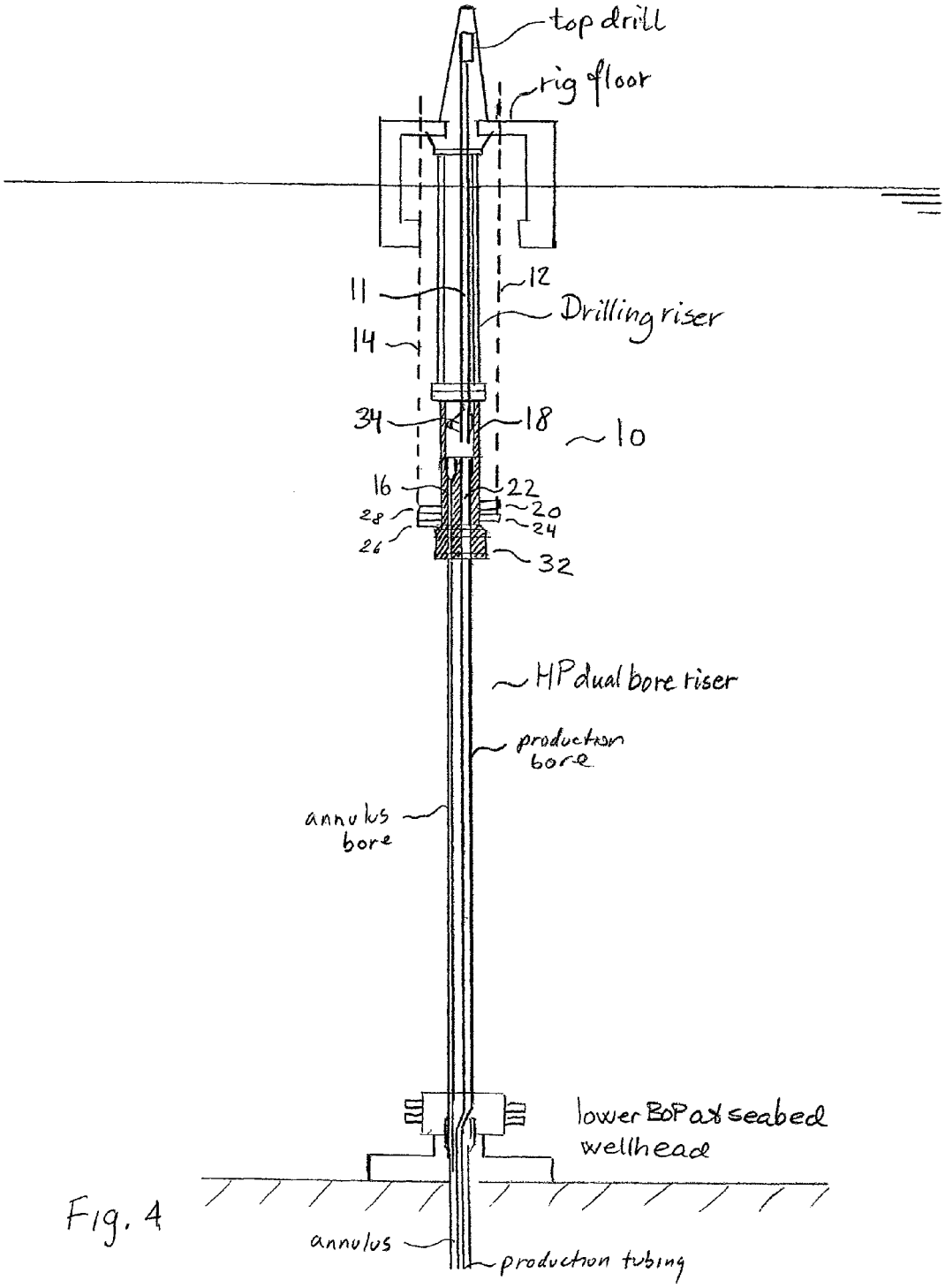
FIG. 4 shows a simplified illustration of FIG. 1 drawn into its context as a sub surface BOP.

A novel and inventive manner of utilizing the high pressure sleeve for dual riser systems is hereby presented.

Some of the principles of the system are similar, but they will cover dual bore riser systems which are used on vertical X-mas tree designs. Such systems require a dual bore riser to allow for installation and removal of plugs in both production- and annulus bore during completion phase and through a plug and abandonment phase. Further to this most wire line and coiled tubing operations in the well are conducted through the production bore. Normal bore sizes for such systems are 5"×2" although such systems can cater for up to 6⅜" ID.

This document describes the benefits for using the high pressure sleeve in a similar set up for dual bore risers, where one high pressure sleeve will be used for both bores. This will present the advantage of not having to pull out the sleeve when operations are to be performed in an opposite bore.

FIG. 1 shows a subsea BOP, generally indicated at 10, to which an HP sleeve 11 is to be connected. The BOP 10 includes a choke line 12, a kill line 14, an annulus bore 16, a sleeve latch 18, a shear ram 20 for production/tubing bore 22 (FIG. 3), an annulus isolation valve 24, lower circulation valves 26, other circulation valves 28, production bore isolation valve 30 and end 32 without riser adapter. FIG. 3 is a top view of the subsurface BOP 10 showing the production/tubing bore 22 and the annulus bore 16.

FIG. 2*a* shows the lower HP sleeve pin end 34 according to an embodiment in tubing bore mode. FIG. 2*b* shows the lower HP sleeve pin end 34 rotated to the annulus bore mode.

FIG. 4 shows a simplified illustration of FIG. 1 drawn into its context as a sub surface BOP.

The method according to the invention comprises simply to disconnect the sleeve from one bore, rotate it 180 degrees and land and lock it in the opposite bore. The principle for the high pressure system is the same. Thus there is presented a novel and inventive manner for changing from using one bore to using a second bore. If compared with the conventional systems of the prior art, this will allow not only avoiding the time consuming and costly installation of high pressure systems from the well head to the rig, whereupon much work must be performed in riding belts, but will also provide advantages upon the system presented by the applicant in U.S. Ser. No. 11/375,061. The system according to U.S. Ser. No. 11/375,061 may serve for dual bore systems as well, but this would necessitate the pulling of the entire string to the rig floor, before reorientation and later insertion.

This will consume costly rig time. In the present invention it is solely necessary to lift the high pressure sleeve, reorient it by using for instance the top drill, and to reinsert it into the subsurface BOP.

The high pressure sleeve for dual bore high pressure risers will have a similar interface to the subsurface BOP through a latch/connector type connection but will further facilitate an orientation system to ensure proper azimuthal match to the subsurface BOP and connector. This may also comprise a soft landing system.

The advantage of this embodiment is that the weather window will be widened and operations in riding belts are drastically reduced. The rig up of the surface equipment can be done without working in the height but being done on rig floor in weather protected environment behind wind walls. Again the inserting and removal of tool strings from the well is eased by being carried out on the rig floor and not in the riding belts above rig floor.

Thus by introducing the high pressure sleeve technology the surface test tree is moved down below the sea level and becomes the subsurface BOP. From the subsurface BOP the low pressure riser system is established and the high pressure sleeve is running from the subsurface BOP and back to rig floor. As in the previously described patent to the applicant, all work is performed on the rig floor and not in riding belts or the like.

The new issue with this high pressure sleeve is that there is control with the well through the choke and kill lines running from the subsurface BOP from both annulus bore and production bore and back to the rig as the existing drilling riser system is used.

The top section of the subsurface BOP comprises a latch which allows for a larger connector than the design of U.S. Ser. No. 11/375,061. The reason for this is to allow the connector to be oriented and to connect up to either annulus or production bore. The connector is designed such that the high pressure mono bore sleeve is connected to either the annulus bore or the production bore, but the design is such that by rotating the sleeve 180 degrees the opposite bore is connected and thus available for high pressure operation. By doing so, the sleeve is solely disconnected, lifted slightly from the bottom of the latch mechanism, rotated, lowered, entered and locked to opposite bore with the BOPs and surface equipment still connected. This will allow for quicker change over between the bores without removing the BOPs, the components and/or the inserted tools which may remain inside the high pressure sleeve. This will allow for much faster and safer wire line operations. Other angular orientations are evidently possible.

It should be noted that the arrangement of the sub surface BOP is novel, and that the use of a sub surface BOP as shown in FIG. 1 is inventive. The split BOP system comprising a lower BOP at the sea bed and a subsurface BOP below the vessel is a feature of the applicant's previous applications, and there is to the inventor's knowledge no system in existence for arranging a sub surface BOP arranged for being connected to a dual bore riser.

The invention claimed is:

1. A subsurface BOP system comprising:

a dual bore sub surface BOP (10) with a production bore (22) and an annulus bore (16) in a bottom of a sleeve latch (18) at a top of the sub surface BOP (10), said sub surface BOP (10) connected to a dual bore riser to a lower BOP at the sea bed, and a high pressure mono bore sleeve (11) extending from said sub surface BOP (10) up to a rig floor, said high pressure mono bore sleeve (11) provided with a connector pin end (34) at its lower end, said connector pin end (34) comprising a portion offset the main axis of the high pressure sleeve (11), said high pressure mono bore sleeve (11) with said connector pin end (34) being constructed and arranged to be connected to one of said annulus or production bores (16, 22) in said sleeve latch (18), and further constructed and arranged to be lifted, by using a top drill, from said one of said annulus or production bores (16, 22), rotated 180 degrees to an opposite of said production or annulus bores (22, 16) and lowered with said connector pin end (34) into said opposite of said production or annulus bores (22, 16).

2. A method for using a subsurface BOP system comprising a dual bore sub surface BOP (10) with a production bore (22) and an annulus bore (16) in a bottom of a sleeve latch (18) at a top of the sub surface BOP (10), said sub surface BOP (10) connected to a dual bore riser to a lower BOP at the sea bed, with a high pressure mono bore sleeve (11) extending from said sub surface BOP (10) up to a rig floor, said high pressure mono bore sleeve (11) provided with a connector pin end (34) at its lower end, said connector pin end (34) comprising a portion offset the main axis of the high pressure sleeve (11), the method comprising the steps of:

connecting said high pressure mono bore sleeve (11) with said connector pin end (34) to one of said annulus or production bores (16, 22) in said sleeve latch (18), lifting said high pressure mono bore sleeve (11) with said connector pin end (34), by using a top drill, from said one of said annulus or production bores (16, 22), rotating said high pressure mono bore sleeve (11) with said connector pin end (34) 180 degrees to an opposite of said production or annulus bores (22, 16), and lowering said high pressure mono bore sleeve (11) with said connector pin end (34) into said opposite of said production or annulus bores (22, 16).

3. The method of claim 2, further comprising:

changing between first operations including sub-sea drilling, and second operations including at least one of well intervention, well completion, and workover.

* * * * *